US005539435A

United States Patent [19]

Uchida et al.

[11] Patent Number: 5,539,435

[45] Date of Patent: Jul. 23, 1996

[54] INK JET RECORDING BLADE WITH ROUNDED TIP

[75] Inventors: Haruo Uchida; Hiroshi Tajika, both of Yokohama, Japan

[73] Assignee: Canon Kabushiki Kaisha, Tokyo, Japan

[21] Appl. No.: 136,194

[22] Filed: Oct. 15, 1993

[30] Foreign Application Priority Data

Oct. 22, 1992 [JP] Japan ..... 4-308209

[51] Int. Cl.[6] ..... B41J 2/005

[52] U.S. Cl. ..... 347/33

[58] Field of Search ..... 347/33; 15/121, 15/245; 141/90

[56] References Cited

U.S. PATENT DOCUMENTS

| | | | |
|---|---|---|---|
| 3,649,987 | 3/1972 | Tomingas et al. | 15/245 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,819,012 | 4/1989 | Kiyohara et al. | 346/140 R |
| 4,951,066 | 8/1990 | Terasawa et al. | 347/33 |
| 5,138,343 | 8/1992 | Aichi et al. | 346/140 R |
| 5,182,582 | 1/1993 | Okamura | 346/140 R |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A cleaning member includes an elastic blade member that elastically deforms when its rounded tip end portion wipes an ejection orifice surface of an ink jet recording head. The rounded portion has a curved surface with a predetermined curvature with respect to the direction of relative movement of the elastic member and the recording head. Thus, a substantially fixed contact angle can be maintained between the rounded portion and the ejection orifice surface during wiping. The cleaning member moves between a cleaning position for cleaning the ejection orifice surface of the recording head and a non-cleaning position spaced from the recording head.

8 Claims, 10 Drawing Sheets

INK JET RECORDING BLADE WITH ROUNDED TIP

BACKGROUND OF THE INVENTION

1. Field of the Invention

The present invention relates to an ink jet recording apparatus for performing recording by ejecting ink from recording means onto a recording medium and, more particularly, to an ink jet recording apparatus having an improved cleaning member for cleaning an ink ejecting surface of the recording means.

2. Description of the Related Art

Recording apparatuses performing the functions of, for example, printers, copying machines or facsimiles, and recording apparatuses used as output apparatuses of work stations and combined apparatuses, such as computers or word processors, are constructed so as to record images (including characters, symbols, etc.) onto recording media such as sheets of paper, thin plastic sheets (for example, plastic sheets for an overhead projector and textiles). Such recording apparatuses can be divided into several groups according to their printing methods: ink jet recorders, wire dot recorders, thermosensitive recorders, thermal transfer recorders, laser beam printers, etc.

Further, such recording apparatuses can be characterized according to the scanning methods they use. A serial-type recording apparatus performs recording by scanning a recording medium in substantially perpendicular directions, that is, a main scanning direction and a sub-scanning direction (the conveying direction of the recording medium). When the recording medium is set in a predetermined recording position, the recording apparatus moves a carriage carrying recording means (a recording head) along a line across the recording medium, that is, in the main scanning direction. After one line of an image, characters or the like, is thus recorded, the apparatus conveys the recording medium a predetermined amount in the sub-scanning direction to enable recording of the next line of an image, characters or the like, that is, to enable performance of main scanning for the next line. The main and sub-scanning operations are thus repeated to record an image, characters or the like, in a desired area on the recording medium.

A line-type recording apparatus has an elongated recording head which substantially covers the entire width of a recording medium, and performs recording by conveying the recording medium only in the sub-scanning direction. When a recording medium is set in a predetermined recording position, the apparatus records an entire line of an image, characters or the like, and then conveys the recording medium a predetermined amount or a pitch to enable recording of the next line of an image, characters or the like. By continuously repeating this operation, the apparatus completes recording on the recording medium.

Ink jet recording, which performs recording by ejecting ink from recording means onto a recording medium, achieves various advantages. For example, it facilitates a reduction in the size of the recording means and an increase in recording resolution and speed. Further, it can perform recording on ordinary paper that requires no special treatment, thereby providing lower operating costs. Still further, ink jet recording avoids substantial impact with the recording medium, and therefore operates at a low noise. Further, it also facilitates color recording using a plurality of color inks.

Ink jet recording heads that use thermal energy to eject ink can be significantly reduced in size, because a recording head having highly-packed liquid passages and ejection orifices can be easily produced by using semiconductor device production techniques, such as etching, vapor deposition or sputtering, to form films of a top plate, liquid passage walls, electrodes, electrothermal converters, etc. on a substrate. Further, by utilizing integrated circuit techniques or micro-processing techniques, thermal ink jet recording heads having a substantial length or the shape of a panel (a two-dimensional head), and full multi-color recording means or high-density packaged recording means can be easily produced.

The ejection orifice surface of an ink jet recording head may collect undesired substances, such as ink, dust, paper dust or the like, during recording operations. To remove such undesired substances from the ejection orifice surface, an ink jet recording apparatus employs a cleaning mechanism for wiping the ejection orifice surface with a cleaning member, such as a rubber blade made of, for example, urethane.

However, because a conventional cleaning mechanism has a cleaning member formed in the shape of a plate or blade, it may not provide sufficient cleaning. For example, if the cleaning area of an ejection orifice surface is curved or sloped instead of flat, the contact angle between the cleaning member and the ejection orifice surface will vary as the cleaning member slides over the ejection orifice surface, which can prevent it from thoroughly cleaning the ejection orifice surface. Variations in the contact angle may also be caused by deterioration of the performance of the cleaning member, which is likely to result after a very long period of use.

FIG. 9 is a schematic perspective view of a scanning-type recording head and a cleaning member of a known ink jet recording apparatus. FIG. 10 illustrates the cleaning operation using the cleaning member shown in FIG. 9. As shown in FIGS. 9 and 10, a recording head 101 has an ejection orifice surface 102 facing recording medium. The ejection orifice surface 102 has a plurality of ejection orifices 103. A region 104 in which the ejection orifices 103 are arranged is recessed in relation to the other portions of the ejection orifice surface 102, in order to protect the ink ejecting portion and solve various technical problems. Undesired substances 105, such as ink droplets or paper dust, may land on the area around the ejection orifices 103.

A rubber blade cleaning member 106, such as a rubber blade, slidable on the ejection orifice surface 102, in the ejection orifice recess region 104, is provided at a position in the travel of the carriage (not shown in FIGS. 9 and 10) outside a recording region but within the operational range of the carriage. When the recording head 101 is moved from a position as shown in FIG. 9 in the direction indicated by arrow A, the rubber blade 106 slides over the ejection orifice surface 102, thus cleaning the ejection orifice surface 102 by removing undesired substances such as ink droplets or paper dust.

FIG. 10 is a schematic view of the recording head 101 and the rubber blade 106 contacting the recording head 101, viewed from the direction indicated by arrow B in FIG. 9. The rubber blade 106 is fastened to a holder 107. The holder 107 is movable substantially perpendicularly to the operational direction of the recording head 101 (arrow A) between a front position at which the rubber blade 106 can contact the recording head 101 and a rear position at which the rubber blade 106 will not interfere with the recording head 101. When the rubber blade 106 is at the front position and the recording head 101 is moved in the direction indicated by the arrow A, the rubber blade 106 slides over the ejection orifice recess region 104, thus performing a cleaning operation to remove the undesired substances 105 from the ejection orifice surface 102.

The conventional cleaning operation will be understood in more detail with reference to FIG. 10. While the rubber blade 106 slides on the ejection orifice surface 102 during the cleaning operation, the contact angle between the cleaning member 106 and the ejection orifice surface 102 varies. The contact angle is measured between the ejection orifice surface 102 and a tangent of the contact edge 108 of the rubber blade 106. When the rubber blade 106 is at a position (a) relative to the recording head 101, the contact angle between the cleaning member 106 and the ejection orifice surface 102 is θa. When the rubber blade 106 enters the recess portion 104 as the recording head 101 is further moved in the direction indicated by arrow A, for example, when the rubber blade 106 is at a position (b), the contact angle becomes θb. When the recording head 101 is further moved in the direction indicated by arrow A so that the rubber blade 106 enters an area in which the depth of the recess region 104 gradually decreases, for example, when the rubber blade 106 is at a position (c), the contact angle becomes θc.

Because the ejection orifice surface 102 is curved, the contact angle θ between the rubber blade 106 and the ejection orifice surface 102 varies as the cleaning member 106 slides over the ejection orifice surface 102. In the case of the recording head as shown in FIGS. 9 and 10, the relation among the contact angles θa, θb and θc is θb>θa>θc. In general, when the contact angle θ between the rubber blade 106 and the ejection orifice surface 102 is within a certain range, high cleaning performance can be achieved. If the contact angle exceeds that range, the rubber blade 106 tends to draw ink out of the ejection orifices 103. If the contact angle becomes smaller than the range (for example, if the angle is θc), the flat side surface of the rubber blade 106 can contact the ejection orifice surface 102, thereby failing to adequately clean the ejection orifice surface 102. Thus, if the contact angle θ between the rubber blade 106 and the ejection orifice surface 102 is out of an appropriate range, insufficient cleaning can result.

Therefore, to achieve sufficient cleaning, the contact angle θ between a cleaning member and the ejection orifice surface must be maintained at an optimal angle over substantially the entire ejection orifice surface. However, because the ejection orifice surface 102 in a conventional ink jet recording apparatus has a recess portion 104 with a curved surface, and because of long-term deterioration of such cleaning members, variation of the contact angle θ is generally inevitable. Therefore, in the conventional approach, a cleaning mechanism fails to perform uniform cleaning or cleaning performance deteriorates after a long period of use.

To eliminate this problem, a few methods can be conceived for reducing variations in the contact angle θ, for example, adjusting the distance of the cleaning member holder 107 from the ejection orifice surface, or rotating the holder 107 in accordance with the shape or slope of the ejection orifice surface 102. However, control for such operations would be very complicated and difficult and mechanisms to accomplish them would be complex and bulky.

SUMMARY OF THE INVENTION

The present invention is intended to eliminate the above-described problems. An object of the present invention is to provide an ink jet recording apparatus comprising an improved cleaning mechanism to uniformly clean an ejection orifice surface, thereby achieving reliable, constant and stable recording.

According to one aspect of the present invention, a cleaning member for cleaning an ejection orifice surface of a recording head of an ink jet recording apparatus comprises an elastic member mounted for relative movement with the recording head and a rounded portion on the elastic member for wiping the ejection orifice surface during the relative movement of the recording head and the elastic member, wherein the elastic member elastically deforms when the rounded portion is wiping the ejection orifice surface and the rounded portion has a curved surface with a predetermined curvature with respect to the direction of relative movement of the recording head and the elastic member.

According to another aspect of the present invention, a method for cleaning an ejection orifice surface of a recording head of an ink jet recording apparatus comprises providing a cleaning member having an elastic member and a rounded portion for wiping the ejection orifice surface, the rounded portion having a curved surface with a predetermined curvature, and moving the recording head and the elastic member relative to each other to elastically deform the elastic member and wipe the ejection orifice surface with the curved surface of the rounded portion, wherein a contact angle between the rounded portion and the ejection orifice surface is maintained at substantially the same angle when the rounded portion is wiping the ejection orifice surface.

In accordance with still another aspect of the present invention, an ink jet recording apparatus comprises a recording head having an ejection orifice surface with discharge ports for discharging ink onto a recording medium, a carriage for movably supporting the recording head, and a cleaning member comprising an elastic member with a rounded portion for wiping the ejection orifice surface during movement of the recording head, the rounded portion having a curved surface with a predetermined curvature with respect to the direction of movement of the recording head.

Further objects, features and advantages of the present invention will become apparent from the following description of the preferred embodiments with reference to the attached drawings.

DETAILED DESCRIPTION OF PREFERRED EMBODIMENTS

Preferred embodiments of the present invention will be described in detail hereinafter with reference to the drawings.

Figure 1:
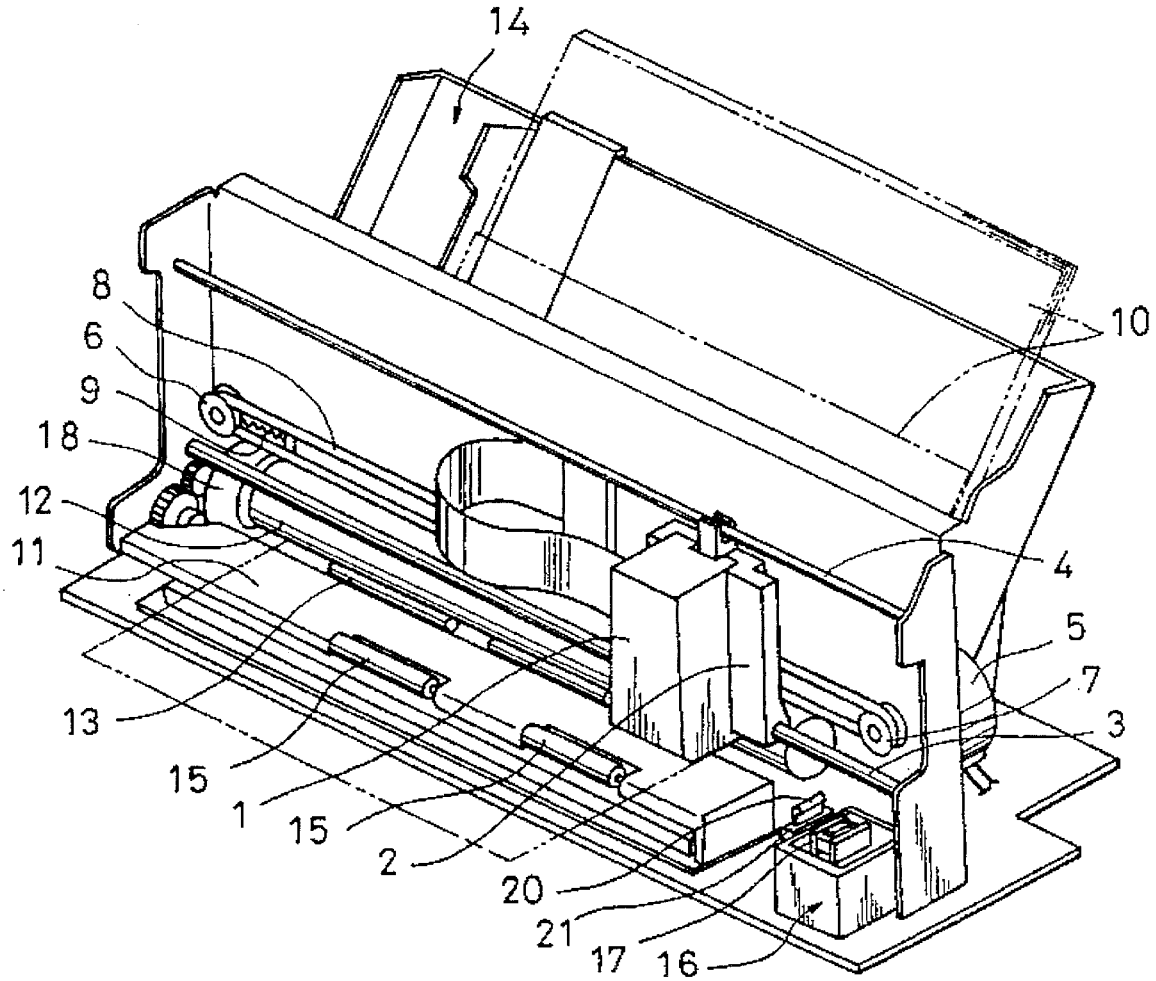
FIG. 1 is a schematic perspective view of an embodiment of the ink jet recording apparatus incorporating an embodiment of the present invention.

Referring to FIG. 1, schematically showing an ink jet recording apparatus according to the present invention, recording means (including a recording head) 1 is mounted on a carriage 2 which is supported by two guide rails 3, 4 so as to be movable back and forth along the guide rails 3, 4 in the main scanning direction. A carriage motor 5 for moving the carriage 2 is provided at an end of the recording apparatus. An idler pulley 6 is provided at the other end. A timing belt 8 is provided between the idler pulley 6 and a motor pulley 7 of the carriage motor 5, so as to be substantially parallel to the guide rails 3, 4. The timing belt 8 is connected at a portion thereof to the carriage 2. The timing belt 8 is provided with a predetermined amount of tension by means of a tension spring 9 connected to the idler pulley 6.

The carriage 2 is reciprocated by the forward and backward operations of the carriage motor 5. The position of the carriage 2, and thus the position of the recording head 1, is controlled by the amount of rotation of the carriage motor 5. While the carriage is being moved, ink is ejected from ejection orifices of the recording head 1 onto a recording medium 10, thus performing recording. In this embodiment, the recording means 1 includes a detachable ink jet cartridge having an ink tank containing ink to be ejected.

The recording head has an electrothermal converter for producing thermal energy to eject ink. In the recording head, the ink is ejected from an ejection orifice by pressure changes caused by the growth and shrinkage of a bubble resulting from film boiling achieved by thermal energy applied to the ink by the electrothermal converter.

Figure 2:
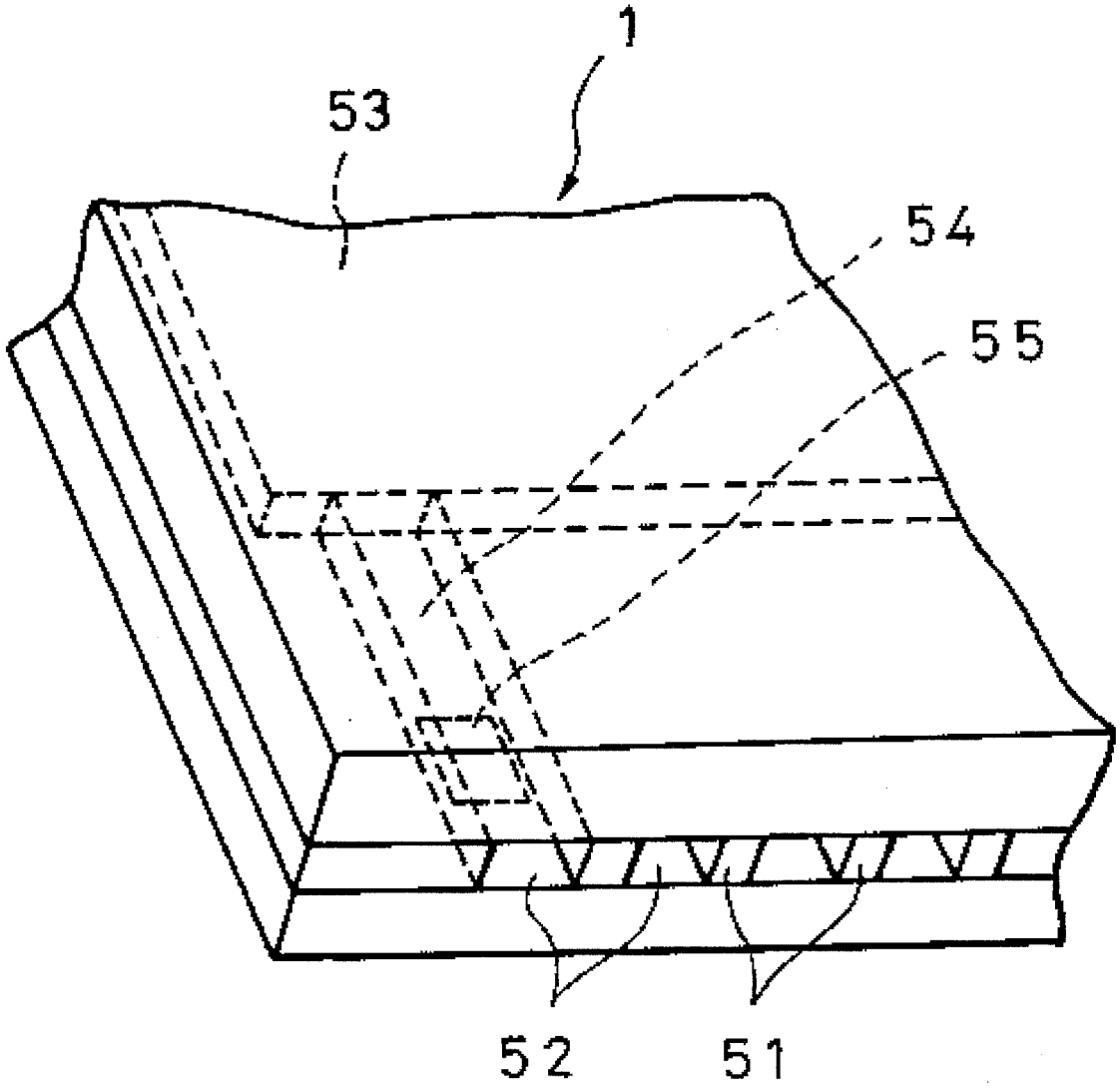
FIG. 2 is a perspective view of part of an ink ejecting portion of recording means used in the recording apparatus shown in FIG. 1.

Referring to FIG. 2 schematically illustrating an ink ejecting portion of the recording means 1, an ejection orifice surface 51, which faces the recording medium 10 with a predetermined gap (for example, about 0.2 to 2.0 mm) left therebetween, is provided with a plurality of ejection orifices 52 arranged with a predetermined pitch. An electrothermal converter 55 for producing thermal energy to eject ink is provided along a wall of each ink passage 54 connecting an ejection orifice 52 and a common ink chamber 53. In this embodiment, the recording head is mounted on the carriage 2 so that the ejection orifices 52 are aligned along a line intersecting the scanning direction of the carriage 2. The thus-constructed recording head performs recording by driving (supplying electricity to) the electrothermal converters 55 in accordance with an image signal or an ejection signal so as to achieve film boiling in the ink inside the corresponding ink passage 54 and, thereby, eject the ink from the corresponding ejection orifice 52.

Referring to FIG. 1 again, a platen 11 having a length substantially equal to the width of the recording medium 10 is disposed parallel to the guide rails 3, 4 so as to face the ejection orifice surface 51 of the recording means 1. The platen 11 supports the recording medium 10 at a predetermined recording position, prevents the recording medium 10 from deforming, and maintains the gap between a recording medium 10 and the ejection orifice surface 51 at a suitable size. A conveying roller 12 is disposed parallel to the guide rails 3, 4, upstream from the recording position defined on the platen 11.

The conveying roller 12 is in firm contact with a pinch roller 13 which is rotatably journaled to a pinch roller holder (not shown) so that the conveying roller 12 and the pinch roller 13 cooperate to convey the recording medium 10 fed by an automatic sheet feeder 14 toward the recording position (a position adjacent to the ejection orifice surface 51). The pinch roller 13 is rotated along with the rotation of the conveying roller 12, and urged onto the conveying roller 12 by a force transmitted thereto from a plate spring or the like by means of the pinch roller holder.

A sheet ejecting roller 15 and a spur roller (not shown) are provided downstream from the recording position defined on the platen 11. The spur roller is pressed onto the sheet ejecting roller 15 so that a recording medium caught therebetween is ejected (conveyed) out of the recording apparatus. The spur roller is rotated along with the rotation of the sheet ejecting roller 15. The roller is urged onto the sheet ejecting roller 15 by a force transmitted thereto from a plate spring or the like by means of a spur roller holder (not shown). The spur roller and the above-described pinch roller 13 can be moved away from the sheet ejecting roller 15 and the conveying roller 12, respectively, by operating a lever or the like, so as to facilitate removal of a sheet of the recording medium 10 stuck in the conveyance path.

The ejecting roller 15 also eliminates any slackness in the recording medium while the recording medium is being conveyed in front of the recording means 1, thus substantially eliminating errors of the recording position and preventing the recording medium from contacting the recording head. To achieve such a function, the sheet ejecting roller 15 is driven synchronously with the conveying roller 12, and the circumferential speed of the ejecting roller 15 is slightly greater than that of the conveying roller 12.

As shown in FIG. 1, a recovery device 16 for recovering the ink ejecting performance of the recording head is provided to the right of the platen 11, outside the recording range. The recovery device 16 has a cap 17 for providing an air-tight covering for the ejection orifice surface 51 of the recording head. When the cap 17 thus covers the ejection orifice surface 51, the recovery device 16 achieves negative pressure inside the cap 17 by means of a suction pump or the like, thereby drawing ink including bubbles, dust, particles, viscous ink and the like from the ejection orifices of the recording head. The cap 17 is movable so as to air-tightly stick to the ejection orifice surface 51 and to separate therefrom. The recovery device 16 may also be used for keeping the ejection orifice 52 moist and free from dust when the recording head is not operated.

The above-described automatic sheet feeder 14, conveying roller 12, ejecting roller 15 and recovery device 16 may be driven by a sheet conveying motor 18 by using transmission means comprising a gear array and a clutch.

A cleaning member (such as a flat rubber elastic blade) 20 for wiping the ejection orifice surface 51 of the recording head along is disposed at a position toward the recording range in relation to the cap 17 of the recovery device 16, that is, between the cap 17 and the platen 11. The cleaning member 20 has a flat elastic blade portion fastened to a holder 21 which is movable forward and backward. The holder 21 is moved forward to set the cleaning member at a position for cleaning the ejection orifice 51.

Figure 3:
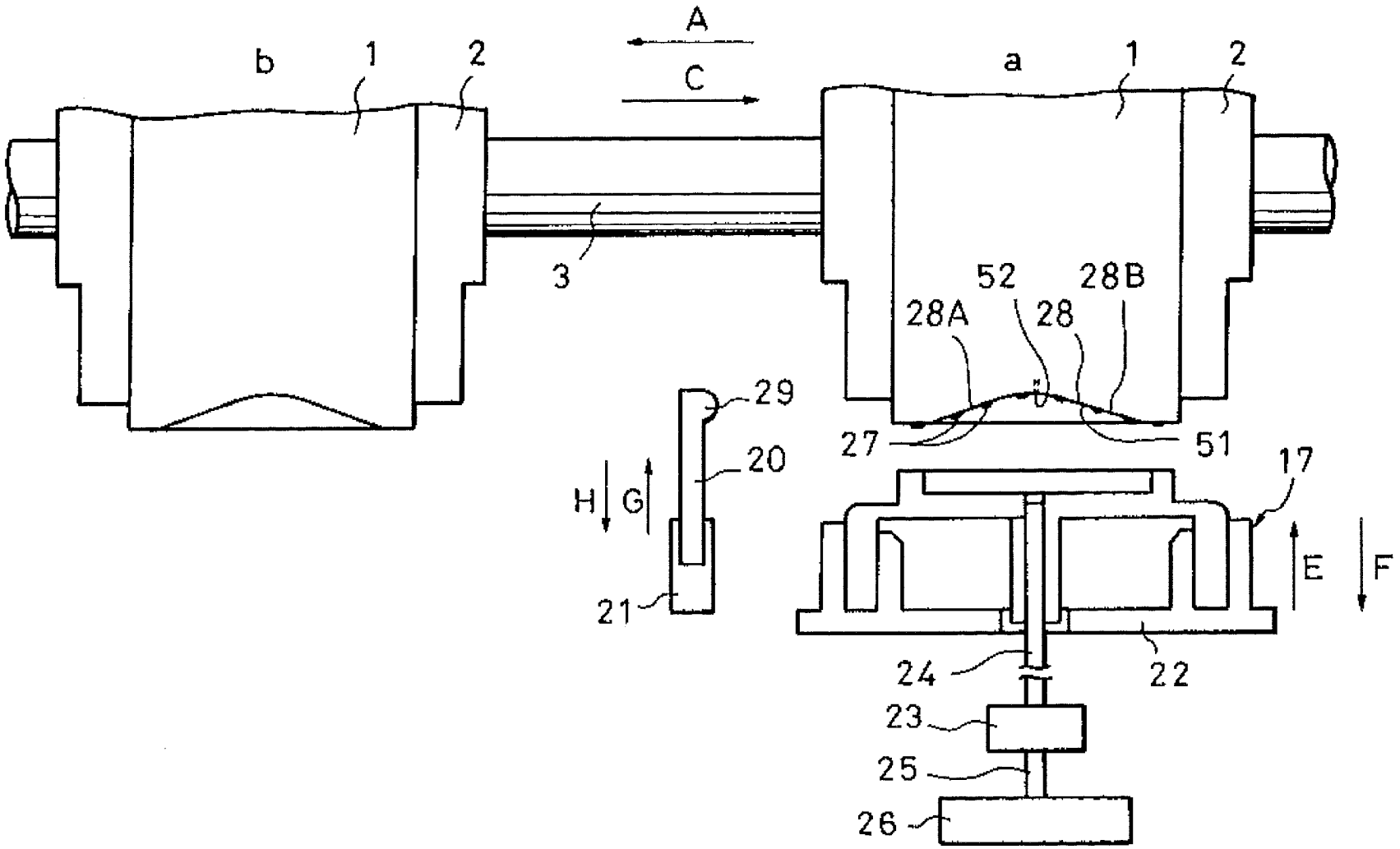
FIG. 3 is a front view of a first embodiment of a cleaning mechanism for an ink jet recording apparatus in accordance with the present invention.
Figure 4:
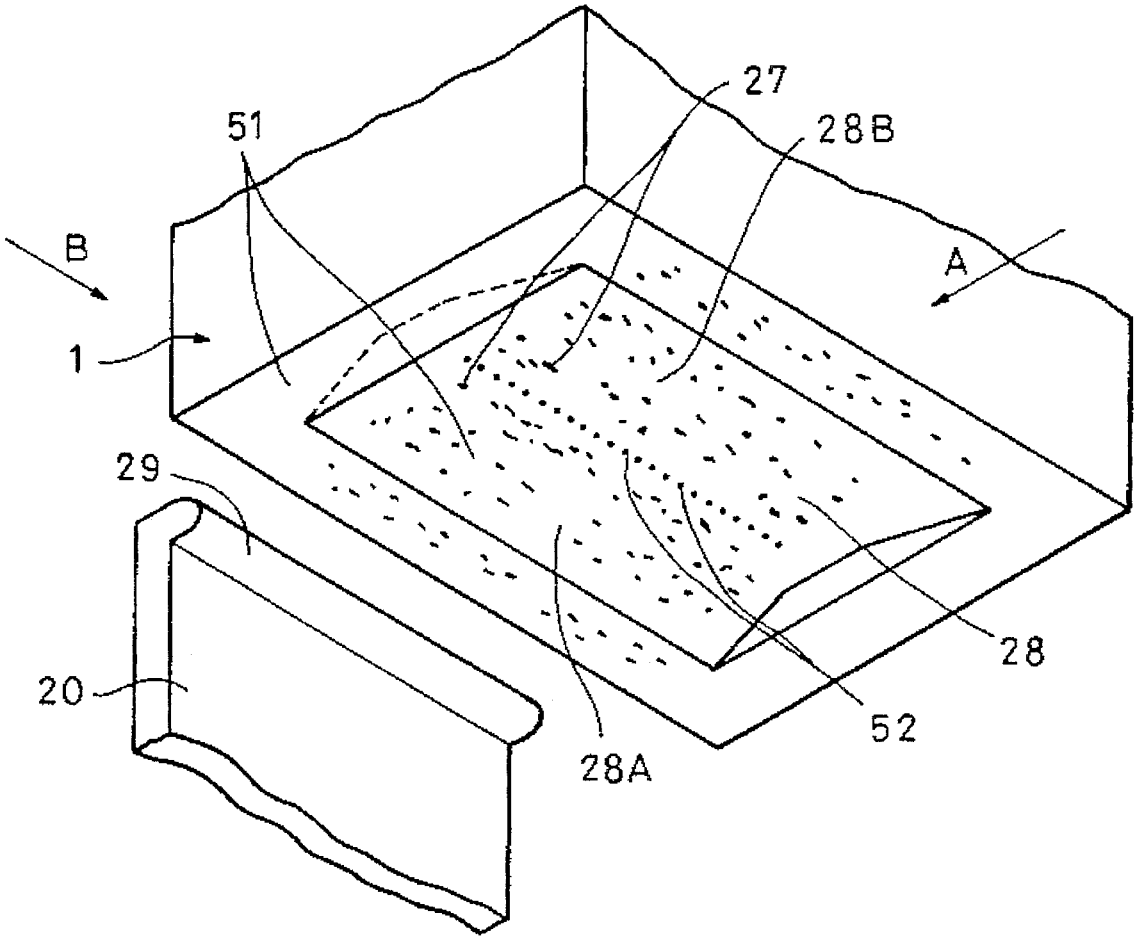
FIG. 4 is a schematic perspective view illustrating the ejection orifice surface and a cleaning member in accordance with the embodiment shown in FIG. 3.

FIG. 3 illustrates the construction and operation of the first embodiment of the cleaning mechanism of the present invention. FIG. 4 is a perspective view of the cleaning mechanism shown in FIG. 3. The carriage 2 carrying the recording means 1 is supported by the guide rails 3, 4 so as to be movable along the guide rails 3, 4 in both the recording direction indicated by arrow A and the returning direction indicated by arrow C. When an ejection orifice 52 is clogged, the recording means 1 is moved to a non-recording position (a) as indicated in FIG. 3, where a suction recovery operation is performed for recovering the clogging.

The suction recovery operation will be described first. When the recording means 1 is at the non-recording position (a), a cap holder 22 supporting the cap 17 is shifted in the direction indicated by arrow E so as to adhere to the cap 17 to the ejection orifice surface 51 and form an air-tight cover over the ejection orifices 52. By operating a suction pump 23 while the ejection orifices 52 are thus capped, negative pressure is achieved in the cap 17 by a tube 24 connected to the suction pump 23, thus sucking ink out of the ejection orifices 52. The ink sucked from the ejection orifices is led by the tube 25 to a waste ink processor 26. After the suction operation, the cap 17 is moved away from the ejection orifice surface 51 in the direction indicated by arrow F, thus completing the suction recovery operation.

During the suction recovery operation, undesired substances 27, such as ink, may well be deposited on the area surrounding the ejection orifices 52. Therefore, after the suction recovery operation, a cleaning operation or process must be performed.

The cleaning operation will now be described. When the suction recovery operation is completed, the carriage 2 is moved in the direction indicated by arrow A. The cleaning member 20 made of, for example, urethane rubber, has already been moved in the direction indicated by arrow G to such a position that the cleaning member 20 can contact the ejection orifice surface 51. Accordingly, as the carriage 2 is moved in the direction indicated by arrow A, the cleaning member 20 wipes the ejection orifice surface 51, thus removing the undesired substances 27 therefrom.

The ejection orifice surface 51 has a recess portion 28 in which the ejection orifices 52 are arranged. During the cleaning operation, the cleaning member 20 wipes the ejection orifice surface 51 including the recess portion 28. After the ejection orifice surface 51 is thus cleaned, the cleaning member 20 is moved in the direction indicated by arrow H to a non-cleaning position spaced from the surface 51.

The above-described cleaning operation can also be performed while recording is in progress. Recording is performed onto a recording medium by the recording means 1 as the carriage 2 is moved across the recording range in the direction indicated by arrow A. When one line of recording is completed, the motion of the carriage 2 is reversed, that is, the carriage 2 is moved back in the direction indicated by arrow C. While the carriage 2 is being returned, the conveying means, including the conveying roller 12 and the like, is driven to convey the recording medium 10 a predetermined amount. Then, the motion of the carriage 2 is reversed at the non-recording position (a), that is, the carriage 2 is moved again in the direction indicated by arrow A, for the next line of recording. This operation is repeated to perform recording onto the recording medium 10. During the recording operation, the undesired substances 27, such as ink droplets, dust, paper dust or the like, may well be deposited on the ejection orifice surface 51. Therefore, the ejection orifice surface 51 needs to be cleaned periodically.

During a recording operation, the cleaning operation is performed as follows. When the carriage 2 is reversed at the non-recording position (a) and moved in the direction indicated by arrow A, a flat elastic blade portion of the cleaning member 20, fastened to the holder 21, can be moved by driving means in the direction indicated by arrow G to the position at which the cleaning member 20 can contact the ejection orifice surface 51. Then, as the carriage 2 is moved in the direction indicated by arrow A, the cleaning member 20 wipes the ejection orifice surface 51, thus removing the undesired substances 27 thereform. After the ejection orifice surface 51 is thus cleaned, the cleaning member 20 is moved back in the direction indicated by arrow H to the non-cleaning position. Thus, the cleaning operation is performed during a recording operation in substantially the same manner as it is performed after a suction recovery operation.

In the embodiment as shown in FIG. 4, the recess portion 28 in which the ejection orifices 52 are arranged is formed of sloped surfaces (curved or flat surfaces) 28A and 28B which face inwards to each other. The cleaning member 20 has a rounded contact portion 29 for contacting the ejection orifice surface 51. The rounded portion 29 comprises a protuberance projected sideways from a terminal end portion of the flat blade and has a substantially semicircular cross-sectional shape. The round surface of the contact portion 29 is formed so as to achieve substantially the same contact angle between the cleaning member and the ejection orifice surface 51 including the recess portion 28, regardless of where the cleaning member 20 contacts the ejection orifice surface 51.

Figure 5:
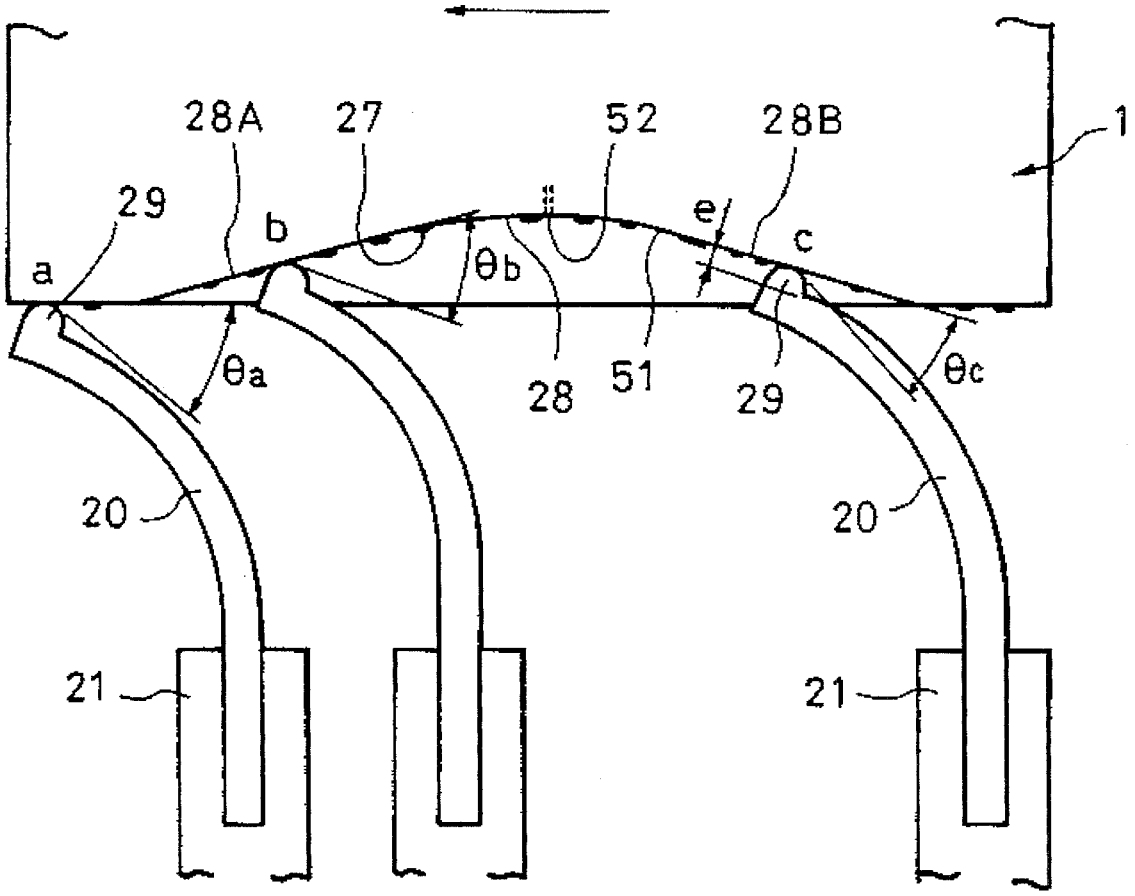
FIG. 5 is a view taken in the direction indicated by arrow B in FIG. 4, illustrating the operation for cleaning the ejection orifice surface.

FIG. 5 is a view of the recording head and recording means 1, and the cleaning member 20, taken in the direction indicated by arrow B in FIG. 4, illustrating the cleaning operation. While the recording means 1 is being moved in the direction indicated by arrow A, the rounded contact portion 29 of the cleaning member slides over and wipes the ejection orifice surface 51, thus cleaning the ejection orifice surface 51.

As the cleaning member 20 slides over the ejection orifice surface 51, the contact state of the cleaning member 20 changes as indicated by numerals a, b and c. At position a, the cleaning member 20 contacts the ejection orifice surface 51 at a contact angle θa. The contact angle is an angle between a tangent to the contact portion 29 of the cleaning member 20 and the ejection orifice surface 51. Then, as the recording means 1 is further moved in the direction indicated by arrow A, the cleaning member 20 comes into the recess portion 28. At position b on the sloped surface 28A along which the depth of the recess portion 28 increases, the contact angle becomes θb. When the recording means 1 is further moved in the direction indicated by arrow A so that the contact portion 29 of the cleaning member 20 reaches the slope surface 28A along which the depth of the recess portion 28 decreases. At position c on the slope surface 28B, the contact angle becomes θc.

Figure 6:
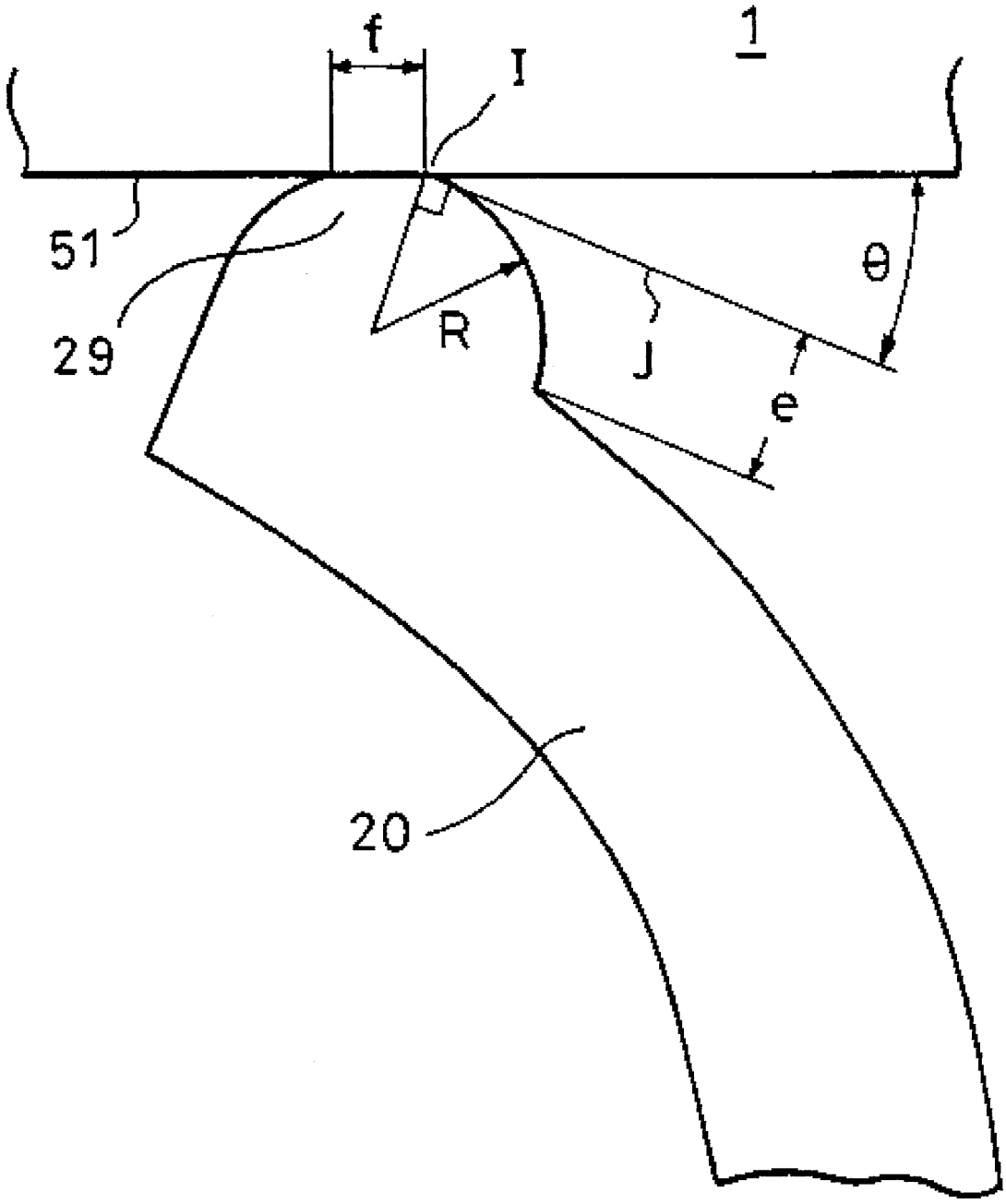
FIG. 6 is an enlarged view illustrating in detail the manner in which the cleaning member of FIGS. 4 and 5 slides on the ejection orifice surface.

FIG. 6 illustrates in detail the contact angle θ between the cleaning member 20 and the ejection orifice surface 51. The round contact portion 29 of the cleaning member 20 being in contact with the ejection orifice surface 51 is slightly deformed by the contact pressure, thus forming a nip f. The contact angle θ is defined as an angle formed between the ejection orifice surface 51 and a tangent J touching the round surface of the contact portion 29 at an end I of the nip f.

Because the contact pressure remains substantially the same over the entire path of the cleaning member along the ejection orifice surface 51, for example, at positions a, b and c, the size of the nip f remains substantially the same. Therefore, the contact angles θa, θb and θc become substantially the same.

In the above embodiment, because the cleaning member 20 for wiping undesired substances, such as ink droplets or dust, from the ejection orifice surface 51 has a rounded tip contact portion 29 having a substantially semicircular cross-sectional shape, the contact angle θ between the cleaning member 20 and the ejection orifice surface 51 remains substantially the same over the entire path of the cleaning member 20 along the ejection orifice surface 51. Accordingly, uniform and appropriate cleaning of the ejection orifice surface 51 can be achieved, even though the ejection orifice surface 51 undulates, and the ink jet recording apparatus can achieve reliable and stable recording. Further, because the tip contact portion 29 of the cleaning member 20 has a rounded contact surface, the actual contact portion of the tip portion 29 gradually shifts as the cleaning member slides over the ejection orifice surface 51, thereby slowing the rate of deterioration of the cleaning member 20 and increasing its service life.

Figure 7:
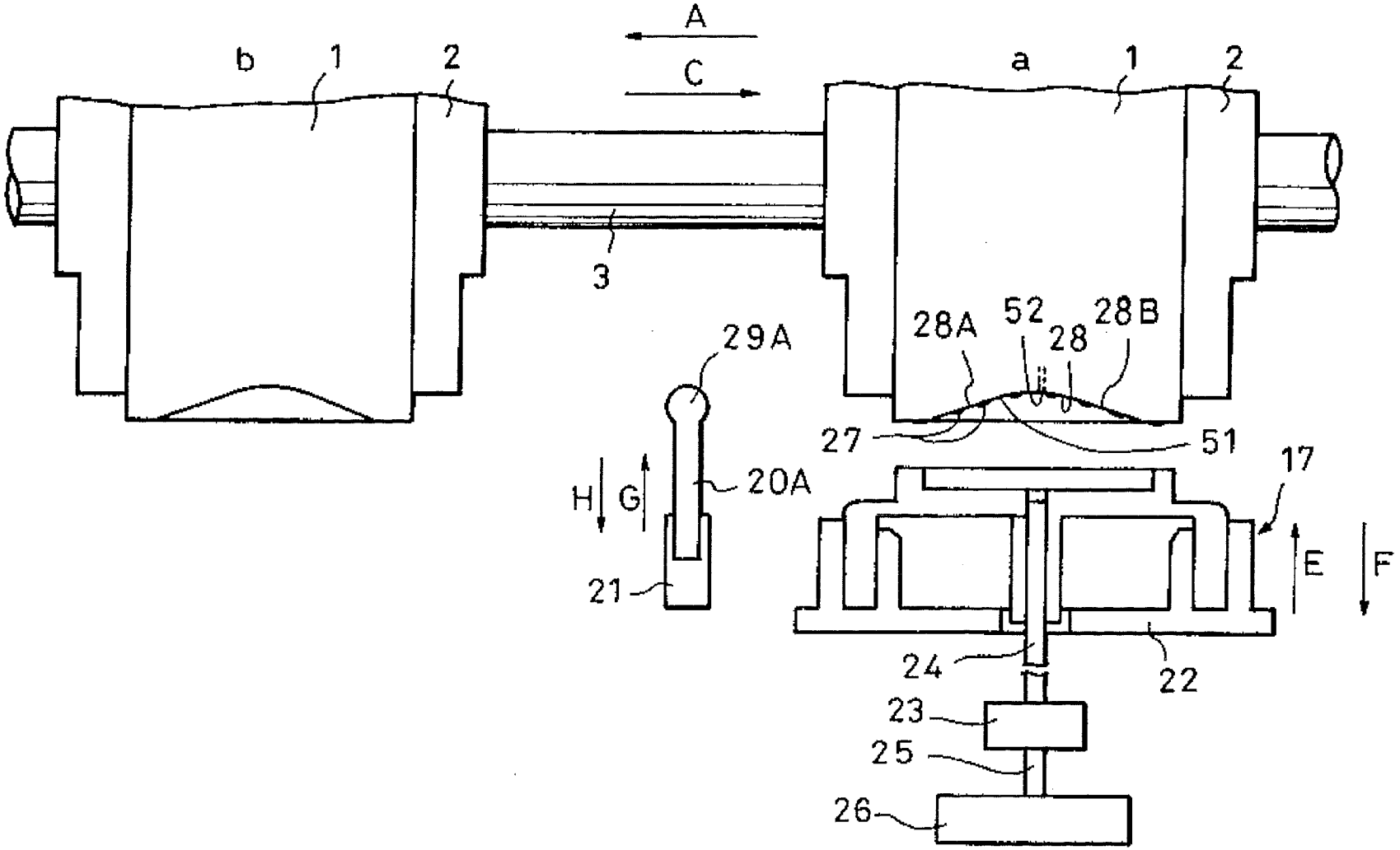
FIG. 7 is a front view of a second embodiment of a cleaning mechanism for an ink jet recording apparatus in accordance with the present invention.

Further, as shown in FIG. 7, a cleaning member 20A having a tip portion 29A rounded at both sides may be provided according to the present invention. If such a cleaning member is employed, the ejection orifice surface 51 can be cleaned regardless of the moving direction of the carriage 2. FIG. 7 thus illustrates another embodiment of the cleaning mechanism employing a cleaning member 20A instead of the cleaning member 20 as shown in FIG. 3. Other than the cleaning member 20A, the cleaning mechanism shown in FIG. 7 is constructed in substantially the same manner as the cleaning mechanism shown in FIG. 3. Parts and components comparable to those in FIG. 3 are denoted by the same numerals in FIG. 7, and will not be described again.

Figure 8:
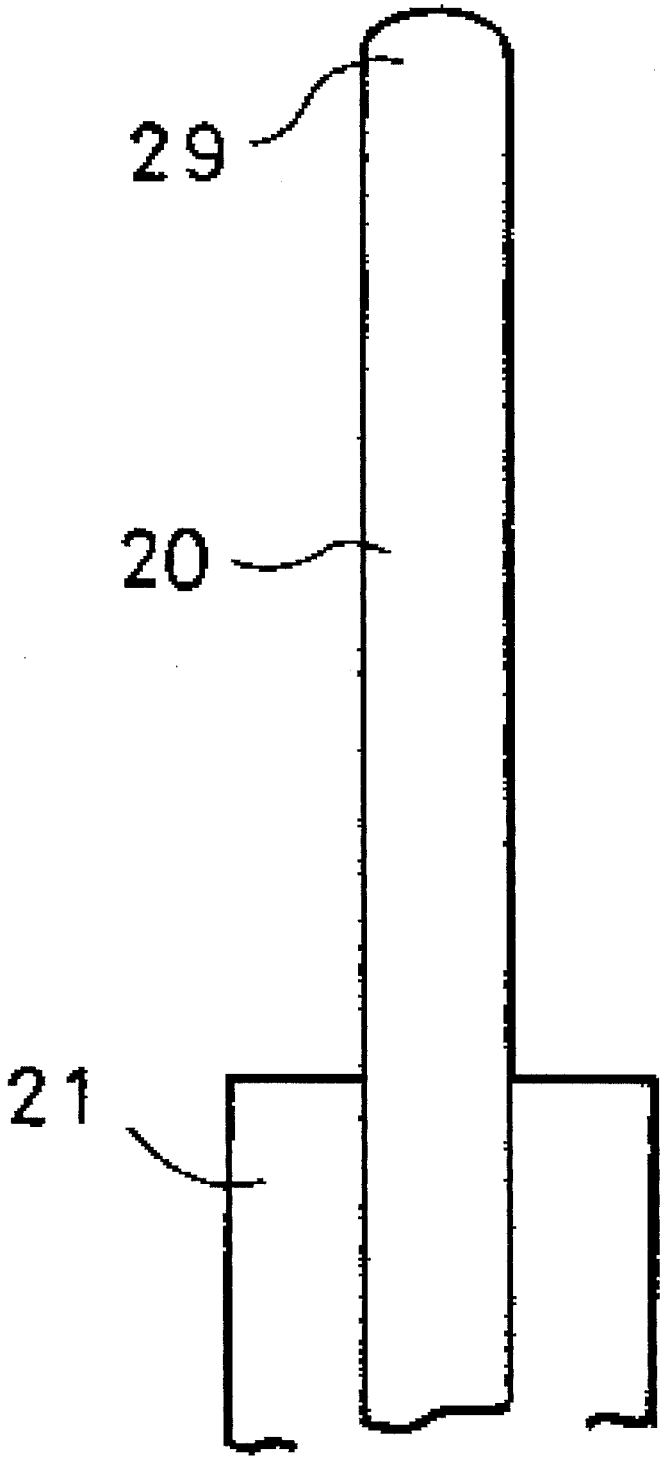
FIG. 8 is a front view illustrating a third embodiment of a cleaning member in accordance with the present invention.
Figure 9:
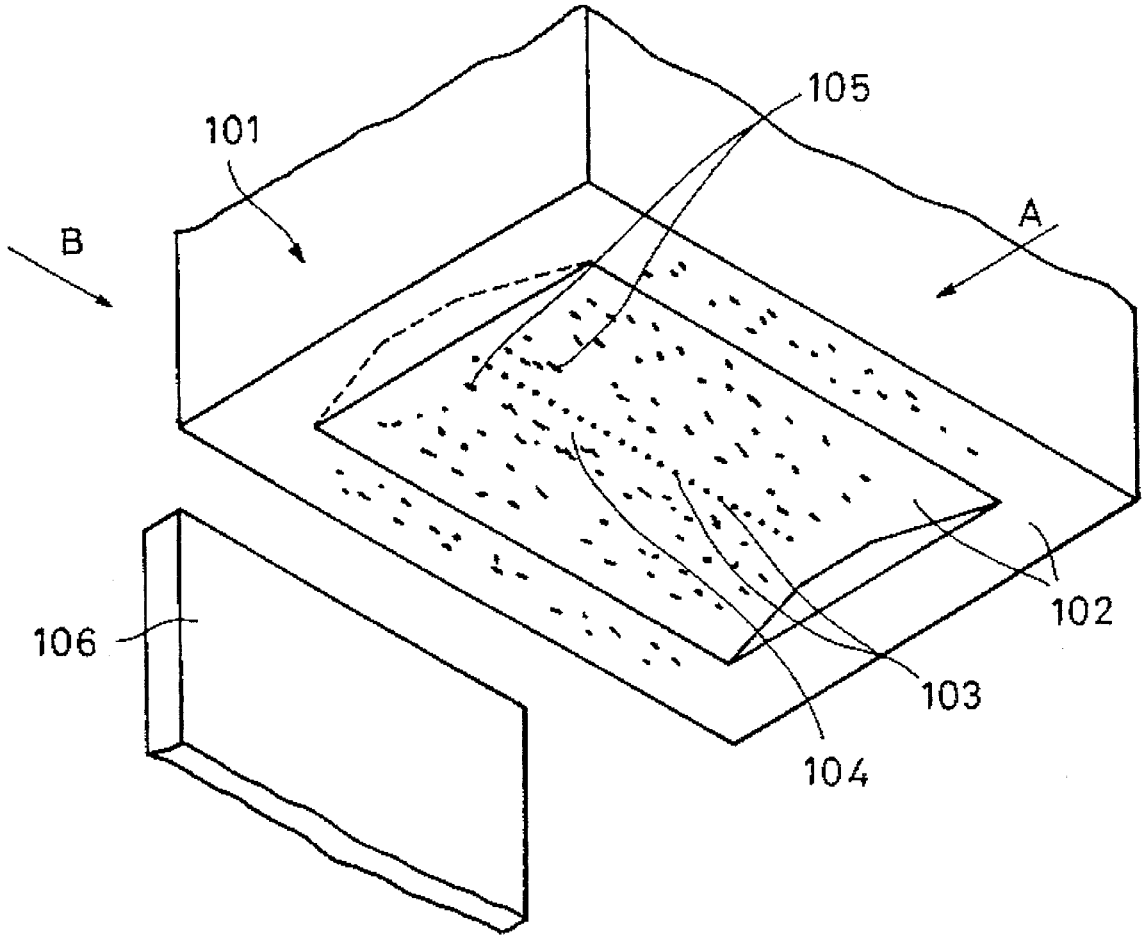
FIG. 9 PRIOR ART
FIG. 9 is a schematic perspective view of a conventional ink jet recording apparatus, illustrating the cleaning member and ejection orifice surface thereof.
Figure 10:
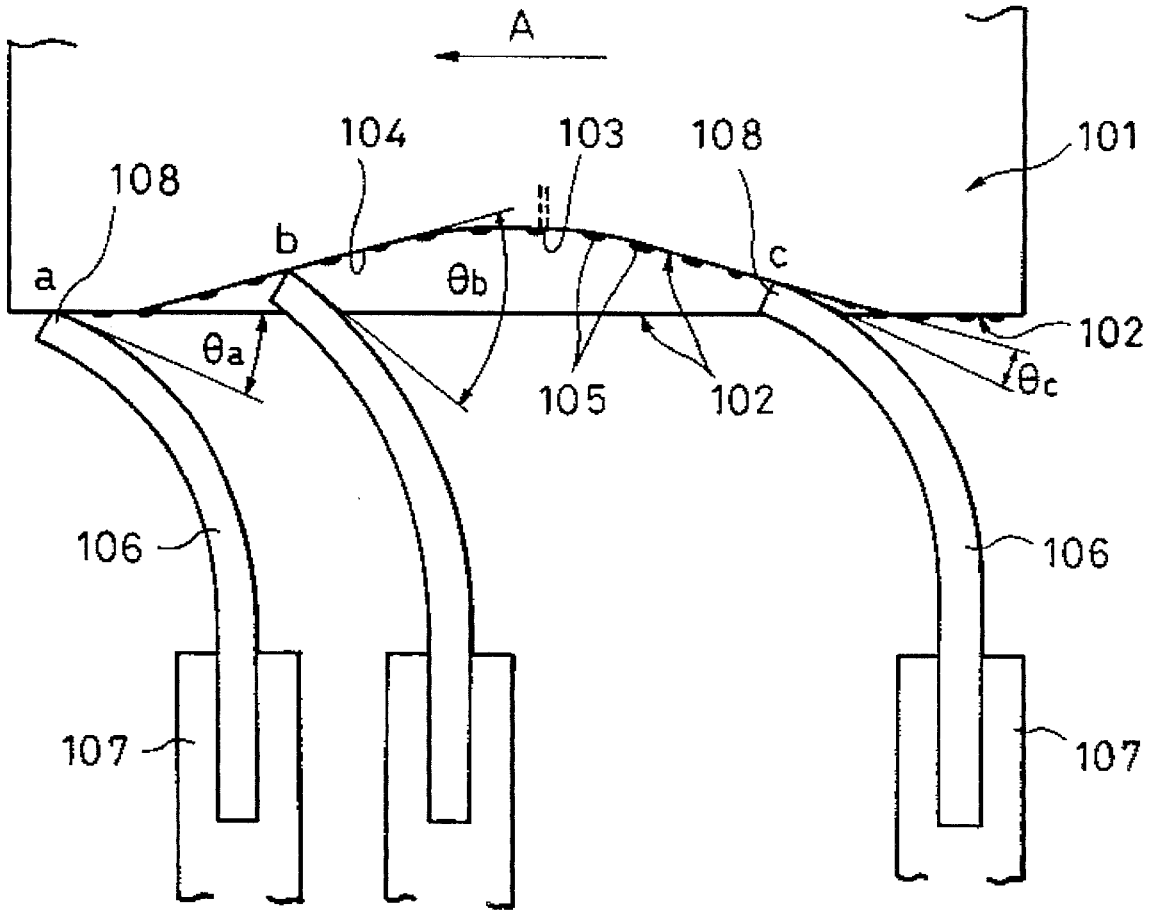
FIG. 10 PRIOR ART
FIG. 10 is a view taken in the direction indicated by arrow B in FIG. 9, illustrating the operation for cleaning the ejection orifice surface.

In the above embodiments, the cleaning members 20, 20A have round tip contact portions 29, 29A protruding a predetermined amount e sideways from the plate-like main blade portions thereof (see FIGS. 5, 6). However, as shown in FIG. 8, the tip portion 29 of the cleaning member 20 may be simply rounded without a protruding portion, if the depth of the recess portion 28 of the ejection surface 51 is sufficiently small that a flat surface portion of the cleaning member 20, that is, a portion other than the round tip portion, will not contact the ejection orifice surface 51. The cleaning member 20 as shown in FIG. 8 will achieve substantially the same advantages as achieved by the above-described cleaning members 20, 20A.

Although the above embodiments are described in connection with a recessed ejection orifice surface 51, the present invention can be suitably applied for cleaning a protruding ejection orifice surface in which ejection orifices are arranged. A cleaning member according to the present invention will achieve a substantially fixed suitable contact angle between the cleaning member and the protruding ejection orifice surface and thus uniformly clean such an ejection orifice surface and achieve substantially the same advantages as mentioned above.

Further, although the present invention has been described with reference to a serial-type or scanning-type ink jet recording apparatus which performs recording by moving a recording head across a recording medium 10, the present invention can also be applied for a line-type ink jet recording apparatus which performs no main scanning but instead uses a line-type recording head having a length that substantially or partially covers the width of a recording medium. In such a case, the present invention will achieve substantially the same advantages as stated above. Further, the present invention can achieve the above-stated advantages, regardless of the arrangement of the recording head and the ink tank, that is, whether they are provided together in one assembly or provided separately.

Still further, although the above embodiments are described in connection with a recording apparatus that has only one recording head, the present invention can also be used with a color recording apparatus employing a plurality of recording heads to achieve recording with a plurality of colors, a gradation recording apparatus employing a plurality of recording heads to achieve mono-color recording with gradation or tones, or like apparatus. Thus, the present invention can achieve substantially the same advantages as stated above, regardless of the number of recording heads, the type of ink, or the number of types of ink that are used by the recording apparatus.

The present invention can be applied to any type of ink jet recording apparatus, for example, an ink jet recording apparatus employing an electromechanical converter such as a piezoelectric element. However, the present invention is particularly effective when applied to a thermal ink jet recording apparatus which uses thermal energy to eject ink, achieving high-density and high-resolution recording.

The preferred construction and principle of such a thermal ink jet recording apparatus may be achieved by using, for example, the principle disclosed in U.S. Pat. Nos. 4,723,129 and 4,740,796. Although the thermal ink jet recording method according to the above U.S. patents is applicable for both an on-demand type and a continuous type, it is more effective when applied to the on-demand type. The on-demand type applies at least one drive signal corresponding to image data to at least one of electrothermal converters provided corresponding to sheets or liquid (ink) passages holding ink, the signal causing an electrothermal converter to produce an amount of thermal energy sufficient to achieve a rapid temperature rise which unfailingly causes film boiling adjacent to the thermally operative surface of the recording means (recording head). Thus, the on-demand type achieves a bubble in the ink corresponding one-to-one to a drive signal.

In response to the growth and shrinkage of such a bubble, the ink is ejected to form at least one droplet. A drive signal having a pulse waveform is preferable because the growth and shrinkage of a bubble can be instantly achieved in response to a drive signal, thus achieving highly responsive ink ejection. Preferred drive pulse signals are described in, for example, U.S. Pat. Nos. 4,463,359 and 4,345,262. Further, recording can be further enhanced by employing the conditions described in U.S. Pat. No. 4,313,124 relating to the temperature increase rate of the thermally operative surface.

According to the present invention, a recording head may be constructed in various manners. Besides constructions using linear ink passages or ink passages with perpendicular corners, the present invention can be used with various other recording heads constructions, such as those shown in U.S. Pat. Nos. 4,558,333 and 4,459,600, in which the thermal operative portion is arranged in a bent portion, in Japanese Laid-Open Patent Application No. 59-123670, in which a common slit for a plurality of electrothermal converters is utilized as an ejecting portion, and in Japanese Laid-Open Patent Application No. 59-138461, in which an opening for absorbing pressure waves of thermal energy corresponds to an ejecting portion. Thus, the present invention can achieve reliable and efficient recording substantially regardless of the construction of a recording head.

Further, as described above, the present invention is applicable for a full-line type recording head having a length corresponding to the maximum width of the recording media that can be used by the recording apparatus. The recording head may be formed by assembling a plurality of recording head units to achieve such a length, or one recording head having such a length may be formed.

In addition, the present invention is applicable for various serial-type recording heads, such as a recording head fixed to the recording apparatus, a detachable-chip type recording head which, when attached to a recording apparatus, achieves electrical connection thereto and a passage for supplying ink therefrom, or a cartridge-type recording head having an ink tank firmly connected to or formed together with the recording head.

Further, according to the present invention, it is preferred to provide means for recovering a recording head and/or auxiliary means for the recovery other than those described above, because such means will enhance the advantages of the present invention. Examples of such means are means for pressurizing means, auxiliary heating means comprising an electrothermal converter or another type of heating element or a combination thereof, or means for operating in an auxiliary ejection mode in which ink is ejected separately from the recording operation.

Further, although the present invention has been described with reference to an ink jet recording apparatus using a liquid ink, the present invention is applicable to an ink jet recording apparatus using other types of ink, for example, an ink which is in a solid state at room temperature or below and liquefies or softens at room temperature. Further, because an ink jet recording apparatus generally controls the temperature of the ink within a range from 30° to 70° C., so as to maintain the viscosity of the ink within a range suitable for stable ejection, the ink jet recording apparatus of the present invention may use any type of ink that is in a solid state when a recording signal is applied, achieving the above-stated advantages. In addition, the ink jet recording apparatus of the present invention may use an ink which is a solid at room temperature and liquefies only when receiving thermal energy corresponding to a recording signal so that the ink is ejected in a liquid form and, optionally, starts solidifying before reaching a recording medium. Such a solid ink is useful for preventing a substantial temperature rise because a large portion of the thermal energy applied to the ink is used to change the ink from a solid to a liquid state. Further, such a solid ink is useful for preventing evaporation of ink when left unused.

According to the present invention, ink may be held in a recess of a porous sheet or in a penetrating hole so as to face an electrothermal converter, as described in Japanese Laid-Open Patent Applications Nos. 54-56847 and 60-71260. According to the present invention, an ink jet recording apparatus employing the film-boiling ejection method described above is very effective with any one of the above-described inks or constructions.

In addition, the ink jet recording apparatus of the present invention can be embodied in the form of an image output terminal of an information processing apparatus, such as a computer, a copying machine combined with reader means, or a facsimile having transmitter and receiver means, or other like types of devices.

As described above, according to the present invention, an ink jet recording apparatus for performing recording by ejecting ink from recording means to a recording medium comprises a cleaning member for wiping an ejection orifice surface of the recording means so as to clean the ejection orifice surface, and the cleaning member has an elastic member and a rounded contact portion having a substantially circular cross-sectional shape that provides a fixed contact angle between the cleaning member and the ejection orifice surface even if the ejection orifice surface is not flat but slopes or undulates. Thus, the ink jet recording apparatus of the present invention achieves substantially uniform and effective cleaning of the ejection orifice surface regardless of the shape of the ejection orifice surface and thereby enhances reliability and stability of recording.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for cleaning a non-flat ejection orifice surface of a recording head of an ink jet recording apparatus, said method comprising the steps of:

providing a cleaning member comprising an elastic member with a rounded portion for wiping said non-flat ejection orifice surface, said rounded portion having a curved surface with a predetermined curvature; and moving said recording head and said elastic member relative to each other to elastically deform said elastic member and wipe said non-flat ejection orifice surface with said curved surface of said rounded portion, wherein a contact angle between said rounded portion and said non-flat ejection orifice surface remains substantially constant when said rounded portion is wiping said non-flat ejection orifice surface.

2. A method according to claim 1, wherein said curved surface comprises a circular segment.

3. A method according to claim 2, wherein said elastic member comprises a flat blade and said rounded portion comprises an enlarged protuberance at a terminal end of said flat blade.

4. A method according to claim 3, wherein said protuberance projects transversely to said flat blade.

5. A method according to claim 1, wherein in said moving step said recording head is moved to wipe said non-flat ejection orifice surface with said rounded portion.

6. A method according to claim 1, wherein said elastic member is movable between a cleaning position wherein said rounded portion can contact said non-flat ejection orifice surface and a non-cleaning position wherein said rounded portion is spaced apart from said non-flat ejection orifice surface.

7. An ink jet recording apparatus comprising:

a recording head having a non-flat ejection orifice surface with discharge ports for discharging ink onto a recording medium;

a carriage for movably supporting said recording head; and a cleaning member comprising an elastic member with a rounded portion at a distal end thereof for wiping said non-flat ejection orifice surface during movement of said recording head, said rounded portion having a curved surface and forming a contact angle with said non-flat ejection orifice surface that remains substantially constant with respect to a direction of relative movement of said recording head and said elastic member.

8. An ink jet recording apparatus according to claim 7, further comprising means for moving said recording head between a cleaning position wherein said rounded member can contact said non-flat ejection orifice surface and a non-cleaning position wherein said rounded portion is spaced from said non-flat ejection orifice surface.

* * * * *

UNITED STATES PATENT AND TRADEMARK OFFICE

CERTIFICATE OF CORRECTION

PATENT NO. : 5,539,435

DATED : July 23, 1996

INVENTORS : HARUO UCHIDA ET AL.

It is certified that error appears in the above-identified patent and that said Letters Patent is hereby corrected as shown below:

COLUMN 1

Line 59, "achieves" should read --has--.

COLUMN 10

Line 62, "heads" should read --head--.

COLUMN 14

Line 6, "spaced" should read --spaced apart--.

Signed and Sealed this

Twenty-fourth Day of February, 1998

*Attest:*

Bruce Lehman

BRUCE LEHMAN

*Attesting Officer*

*Commissioner of Patents and Trademarks*